US012232591B2

(12) United States Patent
Kim et al.

(10) Patent No.: US 12,232,591 B2
(45) Date of Patent: Feb. 25, 2025

(54) CONTENTS CONTAINER

(71) Applicant: YONWOO CO., LTD., Incheon (KR)

(72) Inventors: Soo Hwan Kim, Incheon (KR); Yu Seob Kim, Incheon (KR)

(73) Assignee: YONWOO CO., LTD., Incheon (KR)

( * ) Notice: Subject to any disclaimer, the term of this patent is extended or adjusted under 35 U.S.C. 154(b) by 0 days.

(21) Appl. No.: 18/699,149

(22) PCT Filed: Oct. 12, 2022

(86) PCT No.: PCT/KR2022/015367

§ 371 (c)(1),
(2) Date: Apr. 5, 2024

(87) PCT Pub. No.: WO2023/080461

PCT Pub. Date: May 11, 2023

(65) Prior Publication Data

US 2024/0389733 A1 Nov. 28, 2024

(30) Foreign Application Priority Data

Nov. 4, 2021 (KR) ..... 10-2021-0150184

(51) Int. Cl.

| | |
|---|---|
| ***A45D 34/04*** | (2006.01) |
| ***B65D 25/44*** | (2006.01) |
| ***B65D 35/44*** | (2006.01) |
| ***B65D 35/46*** | (2006.01) |
| ***B65D 47/20*** | (2006.01) |

(52) U.S. Cl.

CPC ..... *A45D 34/04* (2013.01); *B65D 25/44* (2013.01); *B65D 47/20* (2013.01); *B65D 35/44* (2013.01); *B65D 35/46* (2013.01)

(58) Field of Classification Search

CPC ..... A45D 34/04; A45D 34/00; B65D 25/44; B65D 47/20; B65D 25/40; B65D 25/42; B65D 47/00; B65D 35/46; B65D 35/44; B65D 47/24; B65D 47/241; B65D 47/242; B65D 47/245; B65D 47/246

USPC ..... 401/126, 280, 281; 222/504, 507, 526, 222/528, 531, 532

See application file for complete search history.

(56) References Cited

U.S. PATENT DOCUMENTS

| | | | | |
|---|---|---|---|---|
| 5,004,127 A * | 4/1991 | Morel | B65D 47/244 222/521 |
| 8,464,916 B2 * | 6/2013 | De Rosa | B65D 47/2087 222/513 |
| 2017/0129657 A1 * | 5/2017 | Geiger | B65D 47/2068 |

FOREIGN PATENT DOCUMENTS

| | | |
|---|---|---|
| JP | H08-244823 A | 9/1996 |
| KR | 10-1192211 B1 | 10/2012 |
| KR | 10-1279910 B1 | 7/2013 |
| KR | 10-1335570 B1 | 12/2013 |
| KR | 10-2018-0034450 A | 4/2018 |

(Continued)

*Primary Examiner* — David J Walczak

(74) *Attorney, Agent, or Firm* — Bridgeway IP Law Group, PLLC; Sang Ho Lee; Hyun Woo Shin

(57) ABSTRACT

A contents container may include: a container part having a space defined to accommodate contents and including a spout portion disposed on one end of the container part, a shoulder part detachably coupled to the spout portion of the container part, a lifting part coupled to the sealing wall of the shoulder part, a rotating part coupled to the first guide part of the shoulder part, and a cover part that is coupled to the lifting part.

14 Claims, 7 Drawing Sheets

(56) References Cited

FOREIGN PATENT DOCUMENTS

KR 10-1923180 B1 11/2018

* cited by examiner

CONTENTS CONTAINER

TECHNICAL FIELD

The present disclosure relates to a content container.

BACKGROUND ART

Cosmetics can be categorized into basic cosmetics, makeup cosmetics, hair care cosmetics, fragrances, medicinal cosmetics, etc., depending on the functions, and are distinguished into cream, powder, and liquid depending on the states and are stored in suitable containers.

Among them, in case of containers storing liquid contents, there are liquid content containers in which liquid contents are naturally discharged to the outside through an opening by the force of gravity when a user tilts the container. The liquid content containers includes: a container part storing liquid contents; an opening part positioned at the upper portion of the container part to discharge the liquid contents to the outside; and a cover opening and closing the opening part.

However, the conventional liquid containers that discharge contents by tilting the container have a disadvantage in that when the container is erected after tilted to discharge the contents, the liquid contents are pooled in the top of the opening part or flow down outwardly from the opening part, thus causing contamination of the container.

Therefore, there is a need for a content container that can prevent the liquid contents from being pooled in the opening part and from flowing down outwardly from the opening part.

DISCLOSURE

Technical Problem

Accordingly, the present invention has been made in view of the above-mentioned problems occurring in the related art, and it is an object of the present invention to provide a content container.

The objects of the present invention are not limited to those mentioned above, and other objects not mentioned herein will be clearly understood by those skilled in the art from the following description.

Technical Solution

To accomplish the above-mentioned objects, according to the present invention, there is provided a content container including: a container part that accommodates contents and has a spout portion formed on the upper side thereof; a shoulder part that is coupled to the upper side of the container part and has a communication space through which the contents move inwardly; a lifting part that is coupled to the inner side of the shoulder part, moves vertically with respect to the shoulder part by rotation, and has at least one communication hole through which the contents move; a rotating part that is coupled to the outer side of the shoulder part, has a discharge hole formed in the upper side thereof for discharging the contents transferred from the communication hole, and rotates the lifting part while being rotated; and a cover part that is coupled to the upper side of the lifting part, and ascends and descends between a first position which seals the discharge hole while coming into close contact with the rotating part and a second position which opens the discharge hole while being separated from the rotating part, depending on the ascent and descent of the lifting part.

Moreover, when a user tilts the content container in a state in which the cover part is moved in the second position, the contents passes through the discharge hole and is discharged into a space between the cover part and the rotating part.

Furthermore, the lifting part comprises at least one lifting protrusion formed on the side. The shoulder part comprises a first guide part which is placed on the upper side of the spout portion and has at least one guide groove into which the lifting protrusion is inserted When the rotating part rotates, the lifting protrusion moves along the guide groove so that the lifting part is lifted at the same time with rotation.

Additionally, the rotating part comprises a second guide part which is arranged on the outer side of the first guide part and has at least one vertical groove into which the lifting protrusion is inserted. When the rotating part rotates, the lifting protrusion moves along the vertical groove so that the rotating part and the lifting part rotate synchronously and the lifting part ascends and descends with respect to the rotating part.

In addition, the shoulder part further comprises a communication tube, which is penetrated vertically to form a communication space therein and allows the lifting part to be placed on the upper side thereof, The lifting part further comprises a guide protrusion protruding downward from a docking part placed in the communication tube to a predetermined length. The communication hole is arranged on the outer side of the guide protrusion so that the movement of the contents to the communication hole is guided by the guide protrusion.

Moreover, the lifting part further comprises a coupling protrusion protruding upward from the docking part and coupling with the cover part.

Furthermore, the shoulder part further comprises a sealing wall positioned outward from the communication tube, and the lifting part further comprises a first sealing tube of a soft material extending downward from the periphery of the docking part to gradually increase the diameter downward, thereby getting in close contact with at least a portion of the inner side of the sealing wall.

Additionally, the lifting part further comprises a first blocking part extending downward from the docking part outside the guide protrusion, getting in close contact with the inner surface of the communication tube when the cover part is in the first position, and being separated from the communication tube when the cover part is in the second position. The at least one communication hole is formed between the first sealing tube and the first blocking part.

In addition, on the upper surface of the shoulder part, formed are: at least one limitation jaw getting in contact with at least one rotation limitation protrusion formed on the rotating part to limit the rotation radius of the rotating part; and at least one maintaining protrusion spaced apart from the limitation jaw and formed to maintain the arrangement of the rotation limitation protrusion in contact with the limitation jaw.

Moreover, the rotating part further comprises a discharge tube arranged on the upper side of the lifting part, and penetrated vertically to form the discharge hole therein. The lifting part further comprises a second sealing tube of a soft material, extending upward from the periphery of the docking part placed on the shoulder part to gradually increase the diameter upward, thereby getting in close contact with at least a portion of the inner side of the discharge tube.

Furthermore, the cover part further comprises a second blocking part extending downward from the upper surface, getting in close contact with the inner side of the discharge tube when the cover part is in the first position, and being separated from the discharge tube when the cover part is in the second position.

Additionally, the upper surface of the rotating part is formed with a curved shape that the height and surface area increase outward.

In addition, on the periphery of the rotating part, a rim part is formed to extend outward with a predetermined slope with respect to the upper surface of the rotating part, thereby preventing the contents from flowing down along the outer peripheral surface of the rotating part.

Furthermore, the content container further includes a blocking plug coupled to the spout portion to block the inflow of contents into the shoulder part, and removed when initially used.

Advantageous Effect

According to an embodiment of the present invention, the content container is configured to discharge the contents by raising and lowering the cover part with a simple rotating manipulation, thereby preventing liquid contents from pooling in the opening and from flowing down outward from the opening part.

Additionally, according to the present invention, when the cover part is raised, the shoulder part, the lifting part, and the rotating part which are the internal structure of the content container can be maintained in the close contact state with each other, thereby preventing leakage of contents from the content container.

Furthermore, according to the present invention, the content container can naturally discharge the content to the outside due to the curved shape of the upper surface of the cover part.

Moreover, according to the present invention, the content container includes the rim part with a predetermined slope formed on the circumference of the rotating part to prevent the contents from flowing down outward from the container, thereby providing a clean user experience.

In addition, according to the present invention, the content container includes the guide protrusion protruding on the lower side of the lifting part to guide the contents introduced from the shoulder part to the lifting part to move into the communication hole, thereby creating a more natural fluid flow.

DESCRIPTION OF DRAWINGS

A brief description of each drawing is provided for better understanding of the drawings referred to in the detailed description of the present invention.

MODE FOR INVENTION

Figure 1:
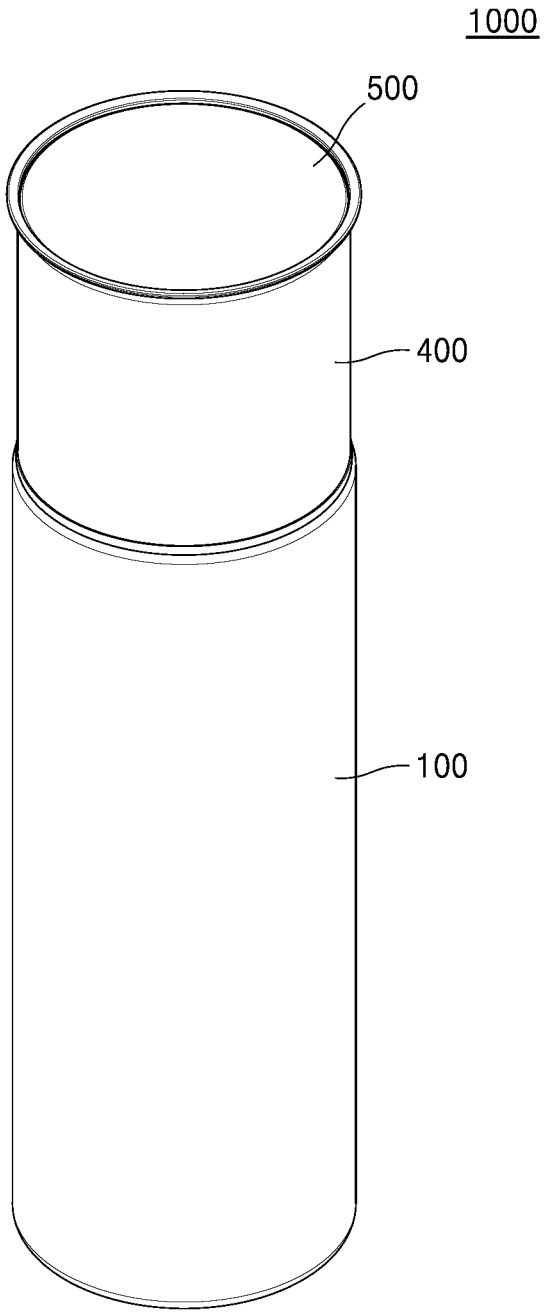
FIG. 1 is a perspective view of a content container according to an embodiment of the present invention.

Hereinafter, exemplary embodiments according to the present disclosure will be described in detail with reference to the contents disclosed in the accompanying drawings. In addition, a method of configuring and using an apparatus according to an embodiment of the present disclosure will be described in detail with reference to the contents disclosed in the accompanying drawings. Like reference numerals or symbols illustrated in the drawings designate parts or components that perform substantially the same functions. For convenience of description, the upward, downward, leftward, and rightward directions are based on the drawings, and the scope of the present disclosure is not necessarily limited in the corresponding directions.

It will be understood that terms, such as "first" or "second" may be used in the specification to describe various components but are not restricted to the above terms. The terms may be used to discriminate one component from another component. For instance, the first component may be named as the second component, and on the contrary, the second component may be also named as the first component within the scope of the present disclosure. The term, "and/or", includes a combination of a plurality of related items or any one item among the plurality of related items.

It will be further understood that the words or terms used in the present disclosure are used to describe specific embodiments of the present disclosure and there is no intent to limit the present disclosure. The singular form of the components may be understood into the plural form unless otherwise specifically stated in the context. It should be also understood that the terms of 'include' or 'have' in the specification are used to mean that there are characteristics, numbers, steps, operations, components, parts, or combinations of the steps, operations, components and parts described in the specification and there is no intent to exclude existence or possibility of other characteristics, numbers, steps, operations, components, parts, or combinations of the steps, operations, components and parts.

Throughout the specification, when a portion is connected to another portion, it may be directly connected to the other portion, or may be indirectly connected to the other portion with another configuration interposed therebetween. In addition, when a portion includes a component, it means that other components may be further included, rather than excluding other components unless otherwise stated.

Figure 2:
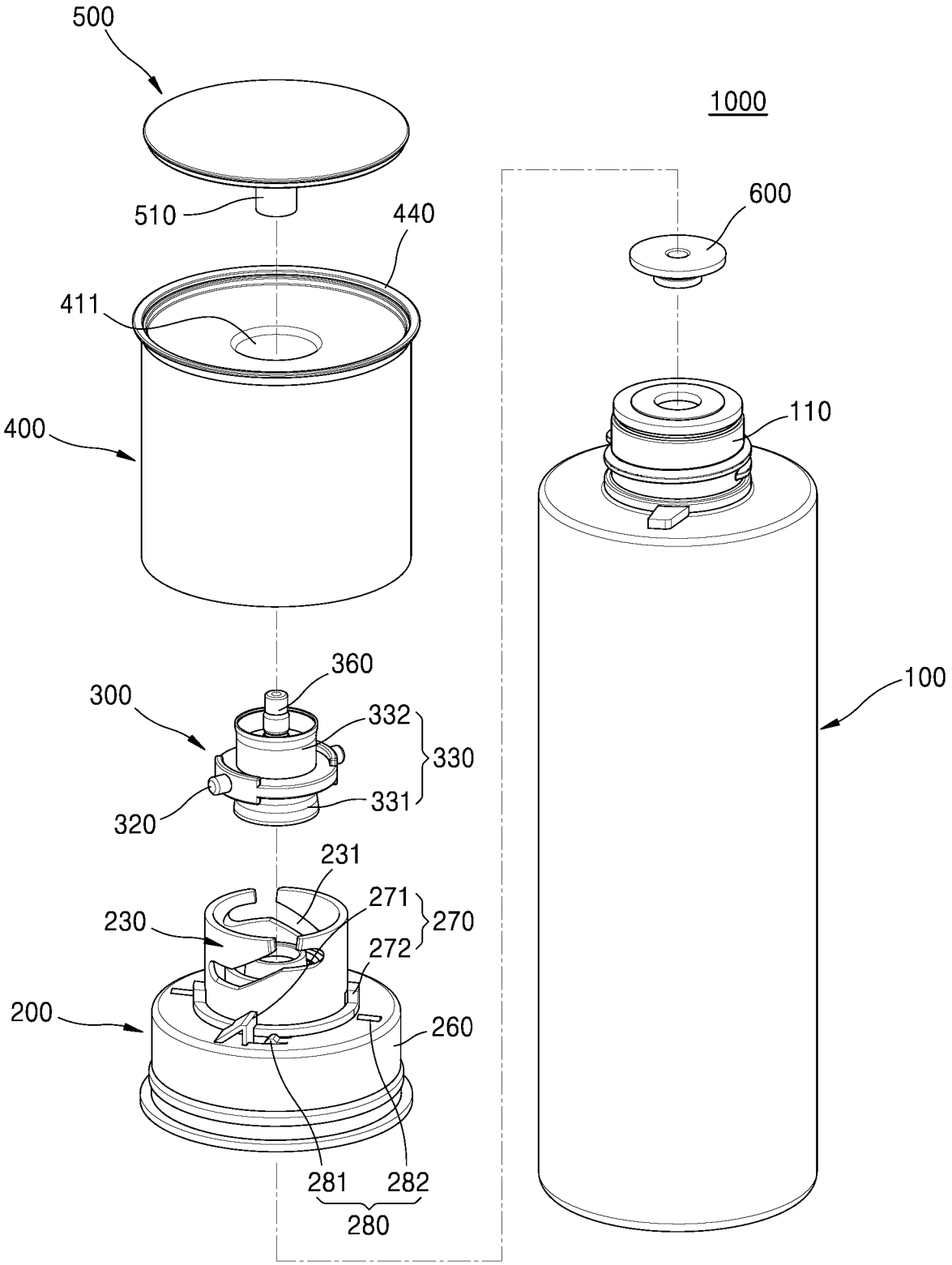
FIG. 2 is an exploded perspective view of the content container according to the embodiment of the present invention.
Figure 3:
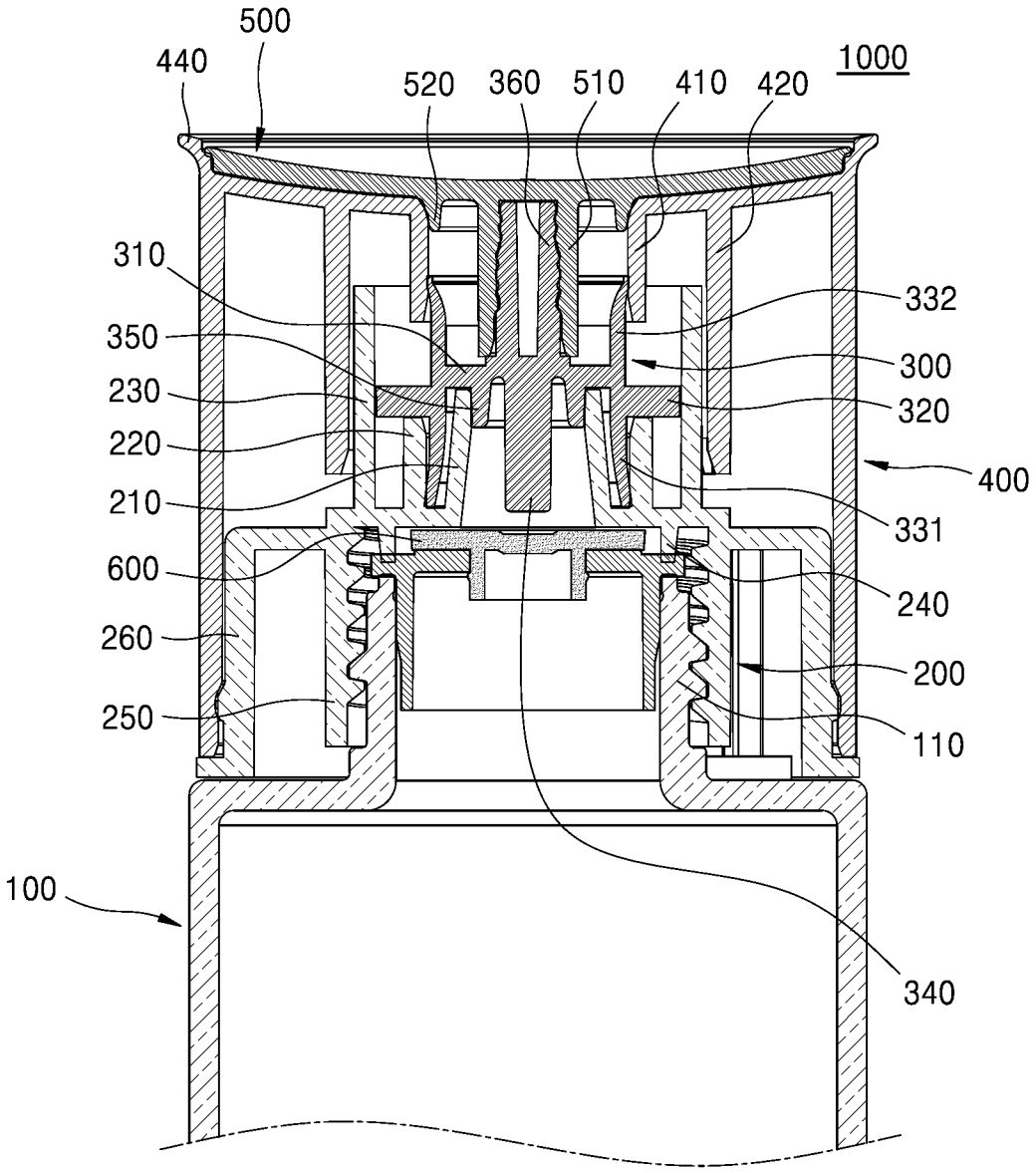
FIG. 3 is a cross-sectional view of the content container according to the embodiment of the present invention.
Figure 4:
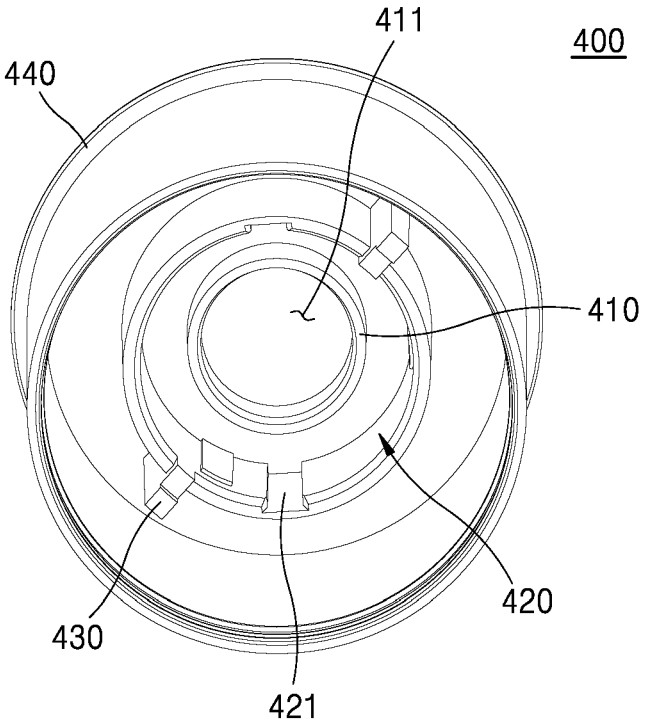
FIG. 4 is a perspective view of a rotating part according to the embodiment of the present invention.
Figure 5:
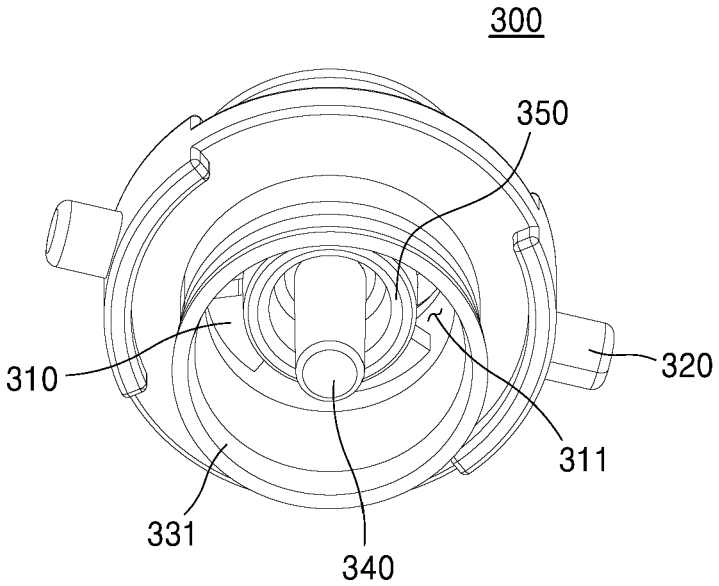
FIG. 5 is a perspective view of a lifting part according to the embodiment of the present invention.

FIG. 1 is a perspective view of a content container according to an embodiment of the present invention, FIG. 2 is an exploded perspective view of the content container according to the embodiment of the present invention, FIG. 3 is a cross-sectional view of the content container according to the embodiment of the present invention, FIG. 4 is a perspective view of a rotating part according to the embodiment of the present invention, and FIG. 5 is a perspective view of a lifting part according to the embodiment of the present invention. In FIG. 3, the lower portion of the container part is omitted for convenience.

Referring to FIGS. 1 to 5, a content container 1000 according to an embodiment of the present invention may include a container part 100; a shoulder part 200; a lifting part 300; a rotating part 400; and a cover part 500.

The container part 100 can accommodate contents. The contents may be cosmetics in liquid, gel, or powder type. For example, the contents may include lotion, milk lotion, moisture lotion, nutrient lotion, skin lotion, skin softener, skin toner, astringent, massage cream, nutrient cream, moisture cream, whitening essence, tone-up cream, sunscreen, sun milk, BB cream, base, foundation, CC cream, concealer, blusher, shading, eyeshadow, eyebrow product, eye cream, primer, etc. However, the contents are not limited thereto, and other formulations or other types of cosmetics, pharmaceuticals, or non-pharmaceutical products may also be included.

In an embodiment, the container part 100 may have a spout portion 110 formed on the upper side thereof. The spout portion 110 is opened at the upper side, such that the contents may be discharged upward from the container part 100 through the spout portion 110 or may be introduced into the container part 100. For instance, the shoulder part 200 may be coupled to the spout portion 110, and the contents discharged upward through the spout portion 110 may be introduced into the shoulder part 200. A screw coupling portion for detachably coupling the shoulder part 200 may be formed on the outer peripheral surface of the spout portion 110.

The shoulder part 200 may guide the lifting of the lifting part 300, and control the discharge of contents to the outside. For example, the shoulder part 200 may be coupled to the spout portion 110 of the container part 100, and a communication space may be provided to allow the contents to move inward. In a state in which the lifting part 300 is lowered, introduction of the contents from the container part 100 to the shoulder part 200 is blocked. However, in a state in which the lifting part 300 is raised, introduction of the contents from the container part 100 to the shoulder part 200 is allowed.

In an embodiment, the shoulder part 200 may include: a communication tube 210; a scaling wall 220; a first guide part 230; and/or a pressure part 240.

The communication tube 210 may penetrate vertically to form an inward communication space and may be arranged on the upper side of the spout portion 110. Additionally, the lifting part 300 may be placed on the upper side of the communication tube 210. In this case, the lifting part 300 can adjust the discharge of the contents while getting contact with and being separated from the end of the communication tube 210.

The sealing wall 220 is in close contact with the lifting part 300, especially the first sealing tube 331, so that contents always move only within the shoulder part 200 and the lifting part 300 inwardly without leaking to the outside. Moreover, even when the lifting part 300 is raised, the contact between the sealing wall 220 and the lifting part 300, especially the first sealing tube 331, can be maintained. For example, the sealing wall 220 may be placed on the upper side of the spout portion 110, specifically, on the upper side of the spout portion 110 and the outer side of the communication tube 210.

The first guide part 230 can guide the lifting of the lifting part 300. For this purpose, the first guide part 230 may have at least one guide groove 231, and the lifting protrusion 320 of the lifting part 300 may be inserted into the guide groove 231. As the lifting protrusion 320 moves along the guide groove 231, the lifting part 300 can be raised at the same time with rotation. For example, the first guide part 230 may be positioned on the upper side of the spout portion 110, and more specifically, on the upper side of the spout portion 110 and on the the outer side of the communication tube 210 (and the sealing wall 220).

The pressure part 240 protrudes downward from the shoulder part 200, and can pressurize the container part 100 when the shoulder part 200 is coupled to the spout portion 110. Thus, the sealing between the shoulder part 200 and the container part 100 is enhanced, and leakage of contents along the coupling area between the container part 100 and the shoulder part 200 can be prevented.

In an embodiment, the shoulder part 200 can be coupled to the spout portion 110 via a container coupling part 250, and can be rotatably coupled to the rotating part 400 via a rotation coupling part 260. For example, the container coupling part 250 may be formed along the outer side of the spout portion 110 for coupling with the spout portion 110 via screw coupling, and the rotation coupling part 260 may be positioned on the outer side of the container coupling part 250 for coupling with the rotating part 400 via snap-fit coupling. However, the coupling method of the present invention is not limited thereto, and various coupling methods such as screw coupling, snap-fit coupling, hook coupling, interlocking coupling, or dovetail coupling as disclosed may be applied depending on the embodiment.

In an embodiment, on the upper surface of the shoulder part 200, especially between the container coupling part 250 and the rotation coupling part 260, at least one limitation jaw 270 and at least one maintaining protrusion 280 may be formed, wherein the at least one maintaining protrusion 280 is in contact with at least one rotation limitation protrusion 430 formed on the rotating part 400 and restricts the rotation radius of the rotating part 400, and the at least one maintaining protrusion 280 is spaced apart from the limitation jaw 270 and maintains the arrangement of the rotation limitation protrusion 430 when the rotation limitation protrusion 430 is in contact with the limitation jaw 270.

In an embodiment, when the user rotates the rotating part 400 in a specific direction (specifically, a direction that causes the rotation limitation protrusion 430 to move toward the limitation jaw 270) in the state in which the rotation limitation protrusion 430 is in contact with the limitation jaw 270, the rotation limitation protrusion 430 and the limitation jaw 270 can move together, thereby causing synchronous rotation of the rotating part 400 and the shoulder part 200. When the rotating part 400 and the shoulder part 200 rotate synchronously, the shoulder part 200 (and the lifting part 300, rotating part 400, and cover part 500 directly or indirectly coupled to the shoulder part 200) can be separated from or coupled to the container part 100.

In an embodiment, the rotation limitation protrusion 430 may pass over the maintaining protrusion 280, but a force greater than a predetermined size may need to be applied to the rotating part 400. That is, when a force smaller than a predetermined size is applied to the rotating part 400, the maintaining protrusion 280 can restrict the movement of the rotation limitation protrusion 430.

In an embodiment, at least one of the maintaining protrusions 280 is elastically deformed and moves downward during rotation of the rotating part 400, thereby allowing rotation of the rotating part 400 with less force applied.

In an embodiment, the limitation jaw 270 may include: a first limitation jaw 271; and a second limitation jaw 272 spaced apart from the first limitation jaw 271 at a predetermined distance. The first limitation jaw 271 is in contact with one side of the rotation limitation protrusion 430, and blocks the movement of the rotation limitation protrusion 430 towards the first limitation jaw 271 to limit the rotation of the rotating part 400 in one direction. Additionally, the second limitation jaw 272 is in contact with the other side of the rotation limitation protrusion 430, and blocks the movement of the rotation limitation protrusion 430 towards the second limitation jaw 272 to limit the rotation of the rotating part 400 in the other direction.

In an embodiment, when the user rotates the rotating part 400 in the other direction in the state in which the shoulder part 200 is coupled to the container part 100 and the rotation limitation protrusion 430 is in contact with the second limitation jaw 272, the rotating part 400 and the shoulder part 200 rotate synchronously and the shoulder part 200 can be separated from the container part 100. Additionally, when the user rotates the rotating part 400 in one direction in the state in which the shoulder part 200 is separated from the container part 100 and the rotation limitation protrusion 430 is in contact with the first limitation jaw 271, the rotating part 400 and the shoulder part 200 rotate synchronously and the shoulder part 200 can be coupled to the container part 100.

In an embodiment, the maintaining protrusion 280 may include: a first maintaining protrusion 281 spaced apart from the first limitation jaw 271 at a predetermined distance; and a second maintaining protrusion 282 spaced apart from the second limitation jaw 272 at a predetermined distance. The first maintaining protrusion 281 may be positioned on the other side of the rotation limitation protrusion 430 when one side of the rotation limitation protrusion 430 is in contact with the first limitation jaw 271, thereby maintaining the position of the rotation limitation protrusion 430. The second maintaining protrusion 282 may be positioned on one side of the rotation limitation protrusion 430 when the other side of the rotation limitation protrusion 430 is in contact with the second limitation jaw 272, thereby maintaining the position of the rotation limitation protrusion 430.

In an embodiment, the first maintaining protrusion 281 may be elastically deformed and move downward during rotation of the rotating part 400, but the second maintaining protrusion 282 is not elastically deformed during rotation of the rotating part 400. This is to differentiate the force to be applied to the rotating part 400 to lift the cover part 500 from the first position to the second position (i.e., the force required for the rotation limitation protrusion 430 to pass over the first maintaining protrusion 281) and the force to be applied to the rotating part 400 to separate the shoulder part 200 from the container part 100 (i.e., the force required for the rotation limitation protrusion 430 to pass over the second maintaining protrusion 282) so that the user can intuitively percept the degree of manipulation of the rotating part 400.

The lifting part 300 can ascend and regulate whether the contents are discharged to the outside. For example, the lifting part 300 can be coupled to the inner side of the shoulder part 200 and ascend with respect to the shoulder part 200 while rotating due to the rotation of the rotating part 400.

In an embodiment, the lifting part 300 may include a docking part 310, a lifting protrusion 320, a sealing tube 330, a guide protrusion 340, a first blocking part 350, and/or a coupling protrusion 360.

The docking part 310 may be placed on the upper side of the communication tube 210 of the shoulder part 200. When the docking part 310 is placed on the communication tube 210, the discharge of contents may be blocked, and when the docking part 310 is separated from the communication tube 210, the discharge of contents may be permitted.

The docking part 310 may have at least one communication hole 311 formed to allow movement of contents. Thus, the contents transferred from the container part 100 to the lifting part 300 via the communication tube 210 and/or spout portion 110 can be discharged upward over the lifting part 300 through the communication hole 311.

The lifting protrusion 320 may protrude on the side of the lifting part 300. The lifting protrusion 320 may be inserted into a guide groove 231 formed in the first guide part 230 of the shoulder part 200 and/or a vertical groove 421 formed in the second guide part 420 of the rotating part 400. This is to synchronize the rotation of the lifting part 300 with the rotating part 400 during rotation of the rotating part 400 and to lift the lifting part 300 with respect to the shoulder part 200 when the lifting part 300 rotates. For example, the lifting protrusion 320 may protrude outward from the docking part 310.

The sealing tube 330 can be in close contact with the shoulder part 200 (especially, the scaling wall 220) and/or the rotating part 400 (especially, the discharge tube 410), such that the contents always move only inside the shoulder part 200, the lifting part 300, and the rotating part 400, thereby preventing leakage to the outside. In this case, since at least a portion of the sealing tube 330 may be formed of a soft material capable of being elastically deformed, the sealing tube 330 can maintain the contact state with the sealing wall 220 and/or the discharge tube 410 despite the lifting of the lifting part 300. For instance, at least a portion of the scaling tube 330 may be formed of polyethylene (PE) material, but is not limited thereto, and various resilient materials may be applied.

In an embodiment, the sealing tube 330 may include: a first sealing tube 331 extending downward from the perimeter of the docking part 310; and a second sealing tube 332. The first sealing tube 331 may be in close contact with at least a portion of the inner side of the sealing wall 220, and since the diameter increases toward the bottom, the contact with the sealing wall 220 can be achieved effectively. In addition, the second sealing tube 332 may be in close contact with at least a portion of the inner side of the discharge tube 410, and since the diameter increases toward the top, the contact with the discharge tube 410 can be achieved effectively.

The guide protrusion 340 may protrude downward from the docking part 310. In this case, the communication hole 311 may be arranged on the outer side of the guide protrusion 340, and the movement of the contents to the communication hole 311 may be guided by the guide protrusion 340. That is, the contents passing through the communication tube 210 may be distributed towards the communication hole 311 while colliding with the guide protrusion 340, thereby ensuring smooth movement of the contents and natural fluid flow.

In an embodiment, to be positioned inside the communication tube 210 even at maximum lifting of the lifting part 300, the guide protrusion 340 may protrude a predetermined length from the docking part 310. Thus, regardless of the lifting of the lifting part 300, the guide protrusion 340 can always guide the movement of the contents to the communication hole 311.

The first blocking part 350 may block the movement of contents from the shoulder part 200 to the lifting part 300 during descent of the lifting part 300 (i.e., when the cover part 500 is in the first position), but allow movement of the contents from the shoulder part 200 to the lifting part 300 during ascent of the lifting part 300 (i.e., when the cover part 500 is in the second position). For this purpose, for example, the first blocking part 350 may extend downward from the outer side of the guide protrusion 340 to the docking part 310, and is in close contact with the inner side of the communication tube 210 during descent (i.e., when the cover part 500 is in the first position), but is separated from the communication tube 210 during ascent (i.e., when the cover part 500 is in the second position).

In an embodiment, at least one communication hole 311 may be formed between the sealing tube 330 and the first blocking part 350. As a result, in the state in which the docking part 310 is placed in the communication tube 210, the contents may not flow into the communication hole 311 due to the first blocking part 350, but when the docking part 310 is separated from the communication tube 210, the contents may flow into the communication hole 311.

The coupling protrusion 360 may protrude upward from the docking part 310, and can couple with the cover part 500 (especially, the coupling tube 510). For example, the coupling protrusion 360 may have at least one fitting protrusion formed on the outer peripheral surface thereof, and the lifting part 300 and the cover part 500 can be coupled when the coupling protrusion 360 is coupled to the inner side of the coupling tube 510. However, the coupling protrusion is not limited thereto, and various coupling structures as known in the art may be applied to the coupling between the lifting part 300 and the cover part 500.

The rotating part 400 is coupled to the outer side of the shoulder part 200, and can rotate the lifting part 300 by being rotated. So, the lifting part 300 is lifted from the inner side of the shoulder part 200. Additionally, the rotating part 400 may have a discharge hole 411 formed on the upper side to discharge the contents delivered from the communication hole 311.

In an embodiment, the rotating part 400 may include: a discharge tube 410, a second guide part 420, and/or a rotation limitation protrusion 430.

The discharge tube 410 may be positioned on the upper side of the lifting part 300, and may be penetrated vertically to form a discharge hole 411 therein. The contents introduced into the lifting part 300 can be discharged to the outside through the discharge tube 410.

In an embodiment, the discharge tube 410 may be in close contact with the second sealing tube 332 of the lifting part 300, so that the contents always move only within the lifting part 300 and the rotating part 400, thereby preventing leakage to the outside. Additionally, even during lifting of the lifting part 300, the close contact between the discharge tube 410 and the second sealing tube 332 can be maintained.

The second guide part 420 can synchronize the rotation of the lifting part 300 with the rotation of the rotating part 400 when the rotating part 400 rotates. For this purpose, at least one vertical groove 421 may be formed in the second guide part 420, and the lifting protrusion 320 of the lifting part 300 may be inserted into the vertical groove 421. When the rotating part 400 rotates, the lifting protrusion 320 can rotate synchronously with the vertical groove 421, thereby allowing the lifting protrusion 320 to lift along the vertical groove 421. For example, the second guide part 420 may extend downward from the upper surface of the rotating part 400 to be positioned on the outer side of the first guide part 230, but is not limited thereto. The second guide part 420 may also be positioned on the first guide part 230.

The rotation limitation protrusion 430 may protrude, for example, outward and/or downward from one side of the second guide part 420. The rotation limitation protrusion 430 can come into contact with the limitation jaw 270 of the shoulder part 200 to limit the rotation radius of the rotating part 400, and can come into contact with the retaining protrusion 280 to maintain the arrangement.

In an embodiment, the upper surface of the rotating part 400 may be formed with a curved shape that the height and surface area increase outward. Accordingly, the contents discharged through the discharge tube 410 can smoothly flow outward along the curved surface of the upper surface of the rotating part 400.

In an embodiment, a rim part 440 may be formed around the periphery of the upper surface of the rotating part 400. The rim part 440 may extend outward from the periphery of the upper surface of the rotating part 400 and may be formed with a predetermined slope in the upward direction. Additionally, according to an embodiment, at least one stepped jaw may be further formed on the inner side of the rim part 440. The rim part 440 can prevent the contents from flowing down along the outer peripheral surface of the rotating part 400 during the discharge process. For example, while the contents move along the upper surface of the rotating part 400 and are discharged outward, when the user changes the tilted angle of the content container 1000 to interrupt the discharge of the contents, the rim part 400 protruding upward and outward prevent the contents from being stained on the outer surface of the content container 1000, thereby providing a neat user experience.

The cover part 500 can be coupled to the upper surface of the lifting part 300, and can ascend and descend between the first position where the cover part seals the discharge hole 411 while coming into close contact with the rotating part 400 and the second position where the cover part opens the discharge hole 411 while being separated from the rotating part 400 depending on the ascent and descent of the lifting part 300. When the user tilts the content container 1000 in the state in which the lifting part 300 moves to the second position, the contents can be discharged through the discharge hole 411 into the space between the cover part 500 and the rotating part 400.

In an embodiment, the cover part 500 may include a coupling tube 510, and/or a second blocking part 520.

The coupling tube 510 protrudes downward from the cover part 500, and have a passage for inserting the coupling protrusion 360 inwardly. In this case, the coupling protrusion 360 may have at least one recess formed on the inner side thereof. As the coupling protrusion 360 is inserted into the coupling tube 510, the lifting part 300 can be coupled with the cover part 500. However, the coupling tube is not limited thereto, and various coupling structures may be applied to the coupling of the lifting part 300 and the cover part 500.

The second blocking part 520 may block the discharge of contents from the discharge tube 410 when the cover part 500 is in the first position, but allow the discharge of contents when the cover part 500 is in the second position. For this purpose, for example, the second blocking part 520 may extend downward from the upper surface of the cover part 500 on the outer side of the coupling tube 510. When the cover part 500 is in the first position, the second blocking part may be in close contact with the inner surface of the discharge tube 410, but when the cover part 500 is in the second position, it may be separated from the discharge tube 410.

In an embodiment, the bottom surface of the cover part 500 may be shaped to correspond to the top surface of the rotating part 400, thereby enhancing the scaling performance.

According to an embodiment, the content container 1000 may further include a blocking plug 600 which is coupled to the spout portion 110 to block the inflow of contents into the shoulder part 200, and is removed when initially used.

In an embodiment, at the time of the initial use of the content container 1000, the user rotates the rotating part 400 and makes the rotation limitation protrusion 430 be in contact with the limitation jaw 270 (especially, the second limitation jaw 272), then continuously rotates the rotating part 400 in the same direction to separate the shoulder part 200 from the container part 100, and then, removes the blocking plug 600 from the spout portion 110. The user can then recouple the shoulder part 200 to the container part 100 from which the blocking plug 600 has been removed, and use the content container 1000.

Figure 6:
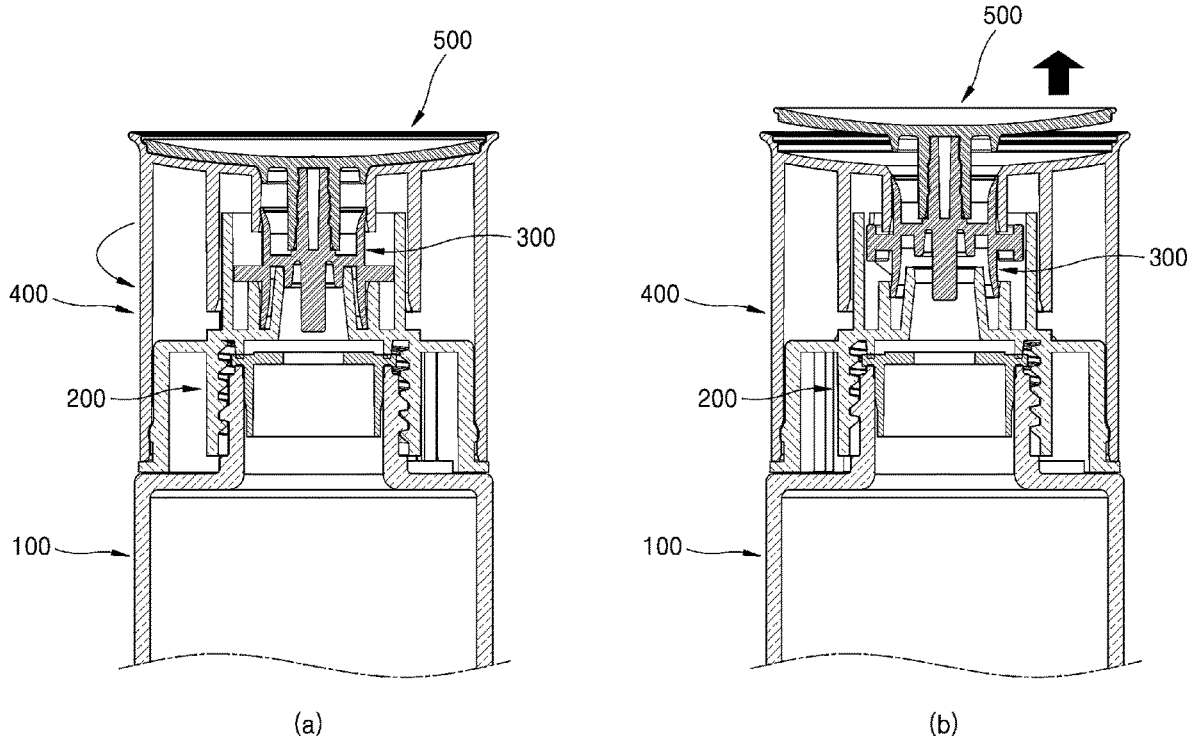
FIGS. 6 to 8 illustrate exemplary operations of the content container according to the embodiment of the present invention.
Figure 7:
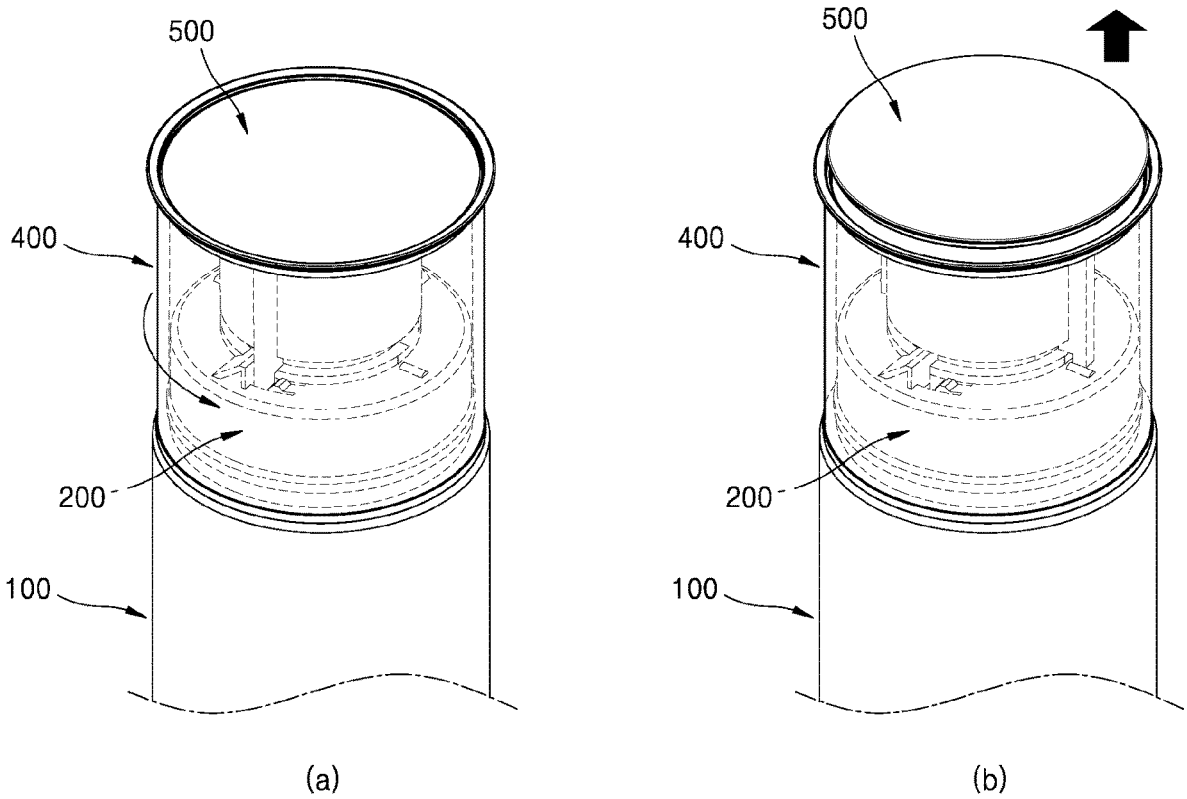
Figure 8:
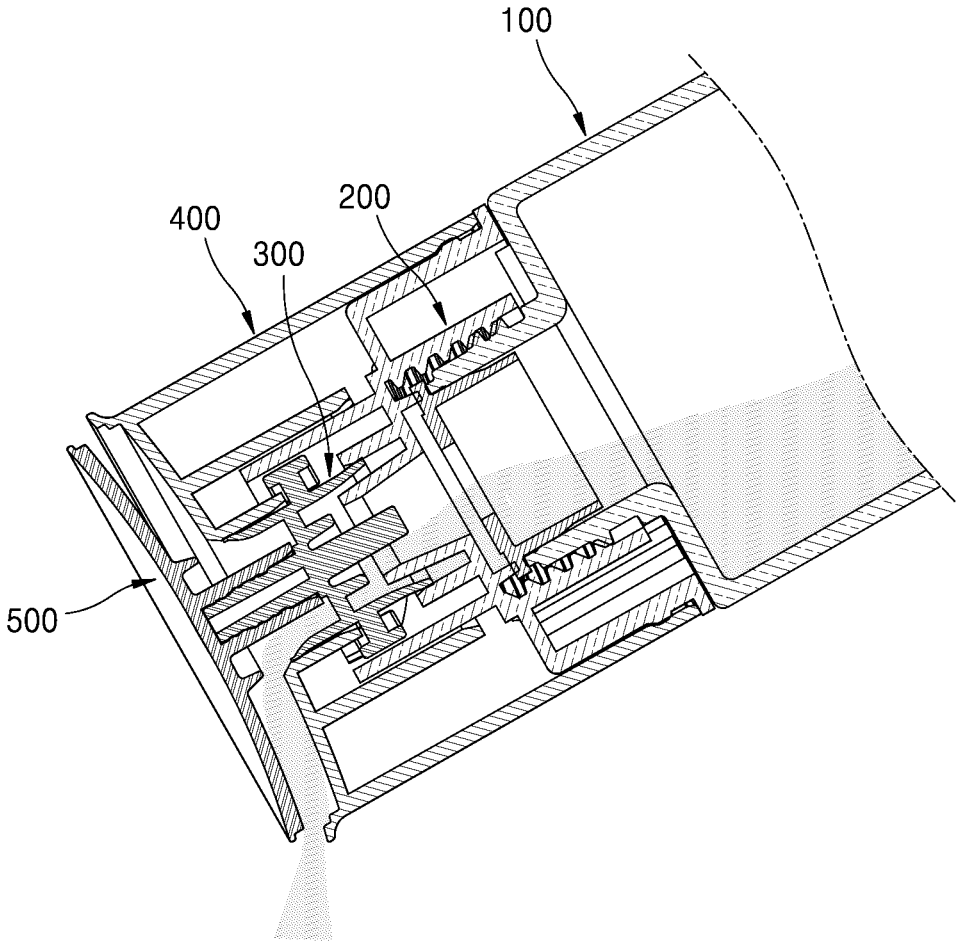

FIGS. 6 to 8 illustrate exemplary operations of the content container according to the embodiment of the present invention. Specifically, FIG. 6(*a*) is a cross-sectional view of the content container 1000 when the cover part 500 is in the first position, and FIG. 6(*b*) is a cross-sectional view of the content container 1000 when the cover part 500 is in the second position. Additionally, FIG. 7(*a*) is a perspective view of the content container 1000 when the cover part 500 is in the first position, showing the interior of the rotating part 400, and FIG. 7(*b*) is a perspective view of the content container 1000 when the cover part 500 is in the second position, showing the interior of the rotating part 400. Furthermore, FIG. 8 illustrates the tilted state of the content container 1000 when the cover part 500 is in the second position. For convenience, the lower portion of the container part 100 is omitted in FIGS. 6-8.

Referring to FIG. 6, when the user rotates the rotating part 400, the vertical groove 421 of the rotating part 400 rotates. At this time, the lifting protrusion 320 also rotates along with the vertical groove 421, and in this instance, the lifting protrusion 320 rotates together with the vertical groove 421 and the lifting part 300 rotates synchronously with the rotating part 400. In this instance, the lifting protrusion 320 moves along the guide groove 231 while rotating, so the lifting protrusion 320 is lifted inside the shoulder part 200. When the lifting part 300 is lifted, the cover part 500 coupled to the lifting part 300 is also lifted together with the lifting part 300, so that the cover part 500 is lifted between the first position where the cover part is in close contact with the rotating part 400 and the second position where the cover part is separated from the rotating part 400.

When the cover part 500 is in the first position, the first blocking part 350 is in close contact with the inside of the communication tube 210, and the second blocking part 520 is in close contact with the inside of the discharge tube 410, thereby blocking the movement of contents to the communication hole 311 and the discharge to the outside through the discharge hole 411. When the cover part 500 ascends to the second position due to the rotation of the rotating part 400, the first blocking part 350 is separated from the communication tube 210, and the second blocking part 520 is separated from the discharge tube 410, thereby allowing the discharge to the outside. Regardless of the lifting of the cover part 500, the sealing tube 330 is always in close contact with the inside of the sealing wall 220 and the discharge tube 410, thereby preventing the contents from leaking out and ensuring that the contents always move only within the sealing wall 220, the sealing tube 330, and the discharge tube 410.

Referring to FIG. 6, when the cover part 500 is in the first position, the rotation limitation protrusion 430 is positioned between the first limitation jaw 271 and the first retaining protrusion 281. In this case, since one side of the rotation limitation protrusion 430 is in contact with the first limitation jaw 271, movement toward the side of the first limitation jaw 271 is blocked, thereby limiting rotation of the rotating part 400 in the first direction. When the rotating part 400 is rotated in a direction different from the first direction, the rotation limitation protrusion 430 can pass over the first retaining protrusion 281. However, a force greater than a predetermined magnitude must be applied to the rotating part 400. When a force less than the predetermined magnitude is applied to the rotating part 400, the first retaining protrusion 281 maintains the position of the rotation limitation protrusion 430.

Subsequently, when the user continuously rotates the rotating part 400 in the second direction, the rotation limitation protrusion 430 moves toward the second retaining protrusion 281. At this point, when the user continuously rotates the rotating part 400, the rotation limitation protrusion 430 can pass over the second retaining protrusion 282, but a force greater than a predetermined magnitude must be applied to the rotating part 400. When a force less than the predetermined magnitude is applied to the rotating part 400, the second retaining protrusion 282 limits the movement of the rotation limitation protrusion 430. As the force greater than the predetermined magnitude is applied, the rotating part 400 rotates further in the second direction, so the cover part 500 moves to the second position. Then, the rotation limitation protrusion 430 is positioned between the second limitation jaw 272 and the second retaining protrusion 282. Since not the one side but the other side of the rotation limitation protrusion 430 gets in contact with the second limitation jaw 272, movement toward the side of the second limitation jaw 272 is blocked, so rotation of the rotating part 400 in the second direction is limited.

Additionally, although not shown in FIG. 6, when the user further rotates the rotating part 400 in the second direction, the rotation limitation protrusion 430 and the second limitation jaw 272 move together, and the rotating part 400 and the shoulder part 200 rotate synchronously, such that the shoulder part 200, the lifting part 300, the rotating part 400, and the cover part 500 are separated from the container part 100.

Referring to FIG. 6, in the state in which the cover part 500 is moved in the second position, when the user tilts the content container 1000, the contents are discharged externally through the communication tube 210, the communication hole 311, and the discharge tube 410. At this point, the guide protrusion 340 of the lifting part 300 guides the flow of contents into the communication hole 311.

As described above, the optimal embodiments has been disclosed in the drawings and the specification. Specific terms have been used herein for descriptive purposes, not for purposes of limitation of meanings or to limit the scope of the invention as set forth in the claims. Therefore, it would be understood by those skilled in the art that various modifications and equivalent embodiments are possible from the present disclosure. Accordingly, the true scope of protection of the present disclosure should be determined by the technical concept of the attached claims.

The invention claimed is:

1. A content container comprising:

a container part having a space defined to accommodate contents and including a spout portion disposed on one end of the container part;

a shoulder part detachably coupled to the spout portion of the container part, wherein the shoulder part comprising:

a communication tube having a communication space to move the contents inwardly;

a first guide part having a first side wall extending in a first direction; and a sealing wall having a second side wall extending in the first direction, wherein a first diameter of the first guide part is greater than a second diameter of the sealing wall;

a lifting part coupled to the sealing wall of the shoulder part, wherein the lifting part moves vertically with respect to the shoulder part by rotation, and has at least one communication hole penetrating the shoulder part to move the contents;

a rotating part coupled to the first guide part of the shoulder part, wherein the rotating part has a discharge hole for discharging the contents transferred from the at least one communication hole, and rotates the lifting part while being rotated; and a cover part coupled to the lifting part, wherein the cover part ascends and descends between a first position which seals the discharge hole while coming into close contact with the rotating part and a second position which opens the discharge hole while being separated from the rotating part, depending on ascent and descent of the lifting part.

2. The content container according to claim 1, wherein when a user tilts the content container in a state in which the cover part is moved in the second position, the contents passes through the discharge hole and is discharged into a space between the cover part and the rotating part.

3. The content container according to claim 1, wherein the lifting part comprises at least one lifting protrusion formed on a circumferential surface of the lifting part, the first guide part has at least one guide groove into which the lifting protrusion is inserted, and wherein when the rotating part rotates, the lifting protrusion moves along the guide groove and the lifting part is lifted at the same time with rotation.

4. The content container according to claim 3, wherein the rotating part comprises a second guide part with a third side wall extending in a second direction having at least one vertical groove into which the lifting protrusion is inserted, and wherein the second direction is opposite to the first direction, and a third diameter of the second guide part is greater than the first diameter of the first guide part, and wherein when the rotating part rotates, the lifting protrusion moves along the vertical groove so that the rotating part and the lifting part rotate synchronously and the lifting part ascends and descends with respect to the rotating part.

5. The content container according to claim 1, wherein the lifting part further comprises a guide protrusion protruding in the second direction from a docking part placed in the communication tube to a predetermined length, and wherein the guide protrusion is configured to guide a movement of the contents to the at least one communication hole.

6. The content container according to claim 5, wherein the lifting part further comprises a coupling protrusion protruding in the first direction from the docking part and coupling with the cover part.

7. The content container according to claim 5, wherein the lifting part further comprises a first sealing tube of a soft material extending and gradually increasing a first radius of the first sealing tube in the second direction, thereby getting in close contact with at least a portion of the sealing wall.

8. The content container according to claim 7, wherein the rotating part further comprises a discharge tube penetrating vertically to form the discharge hole therein, and wherein the lifting part further comprises a second sealing tube of a soft material, extending in the first direction and gradually increasing a second radius of the second sealing tube in the first direction, thereby getting in close contact with at least a portion of the inner side of the discharge tube.

9. The content container according to claim 5, wherein the lifting part further comprises a first blocking part extending in the second direction, getting in close contact with of the communication tube when the cover part is in the first position, and being separated from the communication tube when the cover part is in the second position, and wherein the at least one communication hole is formed between the first sealing tube and the first blocking part.

10. The content container according to claim 9, wherein the cover part further comprises a second blocking part extending in the second direction, getting in close contact with a discharge tube when the cover part is in the first position, and being separated from the discharge tube when the cover part is in the second position.

11. The content container according to claim 1, wherein the shoulder part: includes at least one limitation jaw getting in contact with at least one rotation limitation protrusion formed on the rotating part to limit a rotation radius of the rotating part; and at least one maintaining protrusion spaced apart from the limitation jaw and formed to maintain an arrangement of the rotation limitation protrusion in contact with the limitation jaw.

12. The content container according to claim 1, wherein one surface of the rotating part is a curved shape with an increase in height towards a perimeter.

13. The content container according to claim 12, wherein the rotating part includes a rim part extending outward along the perimeter with a predetermined slope with respect to the one surface of the rotating part and configured to prevent the contents from flowing down along the perimeter of the rotating part.

14. The content container according to claim 1, further comprising:

a blocking plug coupled to the spout portion to block an inflow of the contents into the shoulder part, and removed when initially used.

* * * * *